United States Patent [19]

Darsie et al.

[11] 4,036,262

[45] July 19, 1977

[54] TRIAXIAL WEAVING MACHINE WITH WARP STRAND GUIDES

[75] Inventors: Burns Darsie; Richard A. Schewe, both of Rockford, Ill.

[73] Assignee: Barber-Colman Company, Rockford, Ill.

[21] Appl. No.: 653,490

[22] Filed: Jan. 29, 1976

[51] Int. Cl.[2] ..... D03D 41/00

[52] U.S. Cl. ..... 139/11; 139/DIG. 1

[58] Field of Search ..... 139/1, 11, DIG. 1, 13, 139/14, 15, 16, 17

[56] References Cited

U.S. PATENT DOCUMENTS

| | | | |
|---|---|---|---|
| 1,184,790 | 5/1916 | Trautuetter | 139/DIG. 1 |
| 1,595,403 | 8/1926 | Ingham | 139/11 |
| 3,799,209 | 3/1974 | Dow et al. | 139/DIG. 1 |

FOREIGN PATENT DOCUMENTS

| | | | |
|---|---|---|---|
| 14,098 | 7/1893 | United Kingdom | 139/DIG. 1 |
| 327,099 | 3/1930 | United Kingdom | 139/DIG. 1 |

*Primary Examiner*—Henry S. Jaudon

*Attorney, Agent, or Firm*—Bell, Seltzer, Park & Gibson

[57] ABSTRACT

A weaving machine for making triaxial fabrics and which has a plurality of heddles arranged in weftwise rows for guiding warp strands, an arrangement for shifting warp strands weftwise during weaving, and a creel for supplying warp strands and for rotating in timed relation with the weftwise shifting of the warp strands. In accordance with the present invention, structure is provided for guiding warp strands passing from the creel to the heddles along substantially constant length paths and takes the particular form of a generally circular upper guide having a diameter less than the weftwise length of the rows of heddles and a lower guide arrangement substantially in weftwise alignment with the rows of heddles and yarn separators for the warp strands which move in timed relation with weftwise shifting of the warp strands and rotation of the creel.

17 Claims, 14 Drawing Figures

TRIAXIAL WEAVING MACHINE WITH WARP STRAND GUIDES

Triaxial fabrics and weaving machines for making such fabrics have been known for some time. Recent further development of such fabrics and weaving machines, as exemplified by Dow U.S. Pat. No. 28,155 and Dow et al U.S. Pat. No. 3,799,209, has revived interest in such fabrics and weaving machines due to the desirable properties of such fabrics for certain uses. With revived interest in development of such weaving machines, consideration has been given to optimizing productivity of such machines and, in that connection, to efficient use of floor space and facilitation of ready servicing.

In seeking such ends, it has been proposed that warp strands used in making axial fabrics be supplied to the weaving instrumentalities of a triaxial weaving machine from a creel supported for rotation about a vertical axis in timed relation with weftwise shifting of warp strands. Where such a structural organization is adopted for a triaxial weaving machine, it is necessary to assure that warp strands pass from the creel to the weaving instrumentalities along substantially constant length paths.

It is an object of the present invention to improve warp strand guide arrangements for triaxial fabric weaving machines by facilitating a more compact arrangement of such guide arrangements. In realizing this object of the present invention, structure is provided for engaging warp strands with a generally circular upper guide having a diameter less than the weftwise length of rows of heddles used in a weaving machine and with yarn separators mounted for movement about a closed path of travel substantially parallel to the rows of heddles. The yarn separators move in timed relation with weftwise shifting of warp strands and rotation of a creel from which the warp strands and rotation of a creel from which the warp strands are drawn, while engagement of warp strands with the separators is maintained by a cooperating lower guide arrangement.

Other objects of the invention appear as the description proceeds, when taken in connection with the accompanying drawings, in which.

Figure 3:
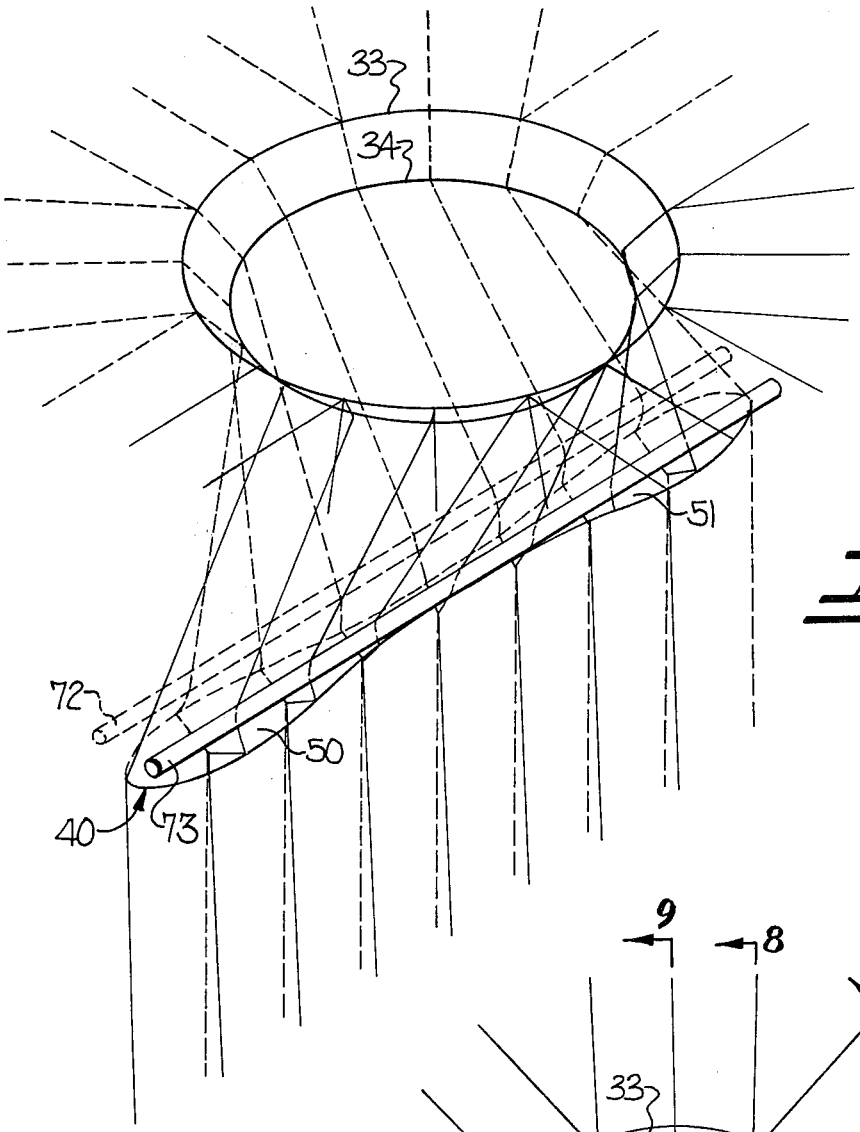
FIG. 3 is a schematic perspective view of the warp strand arrangement of this invention.
Figure 4:
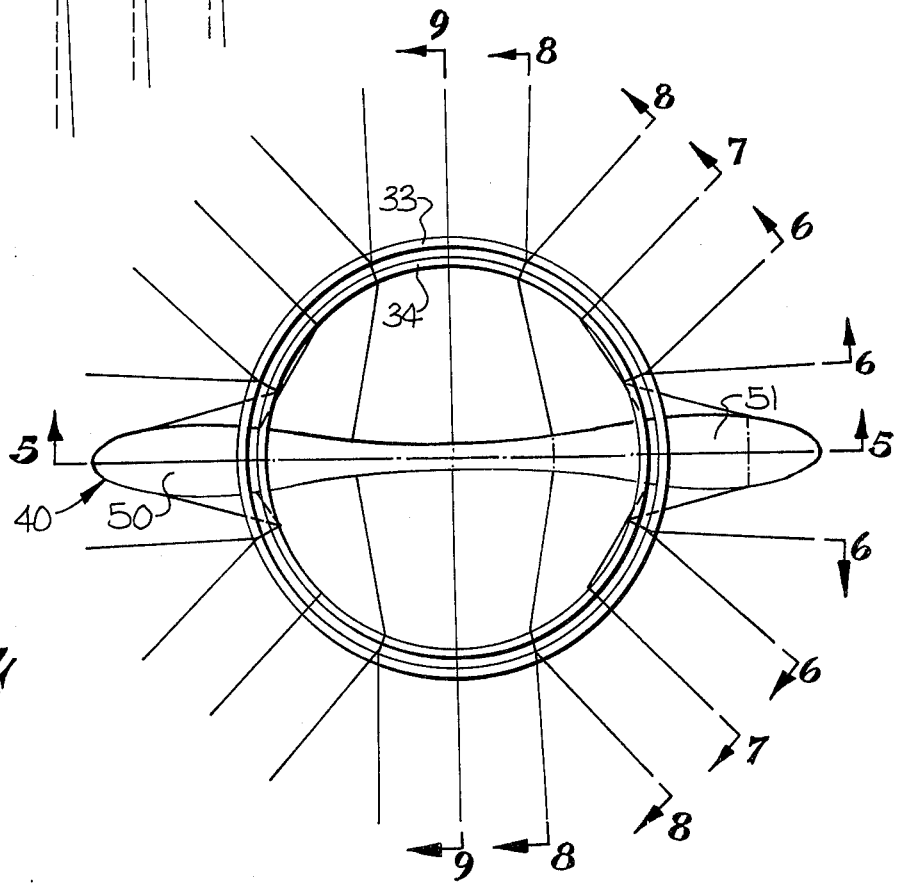
FIG. 4 is a plan view, from above, similar to FIG. 3.
Figure 9:
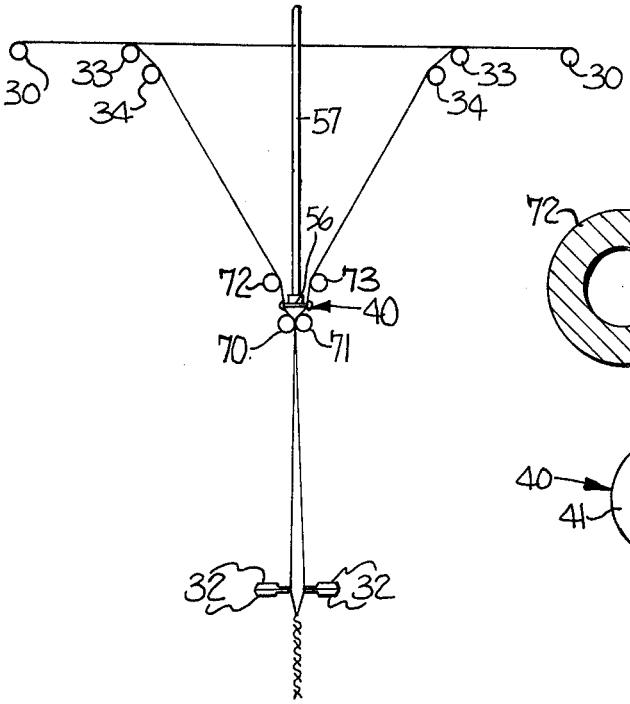
Figure 10:
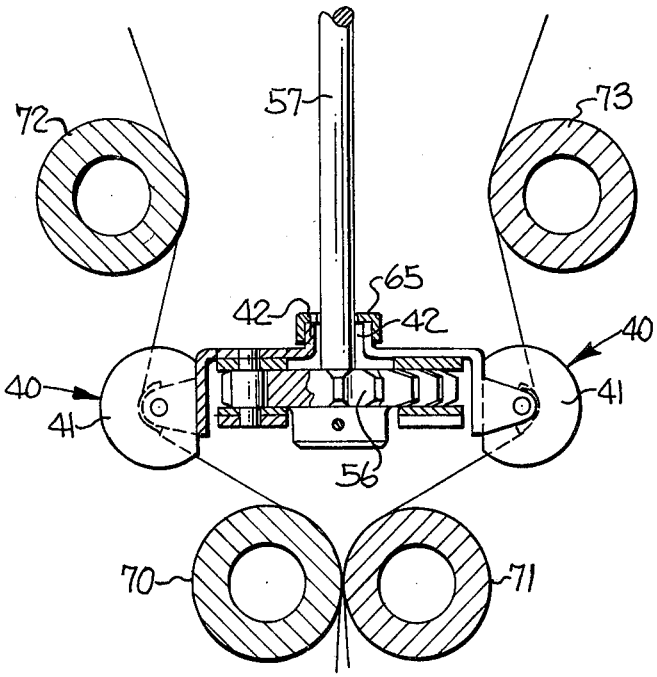
Figure 11:
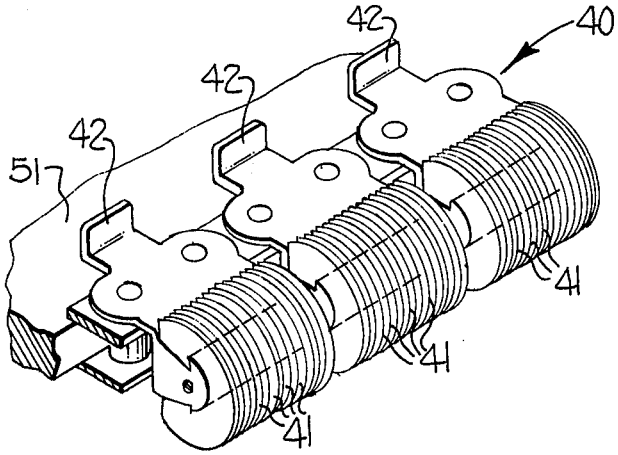
Figure 12:
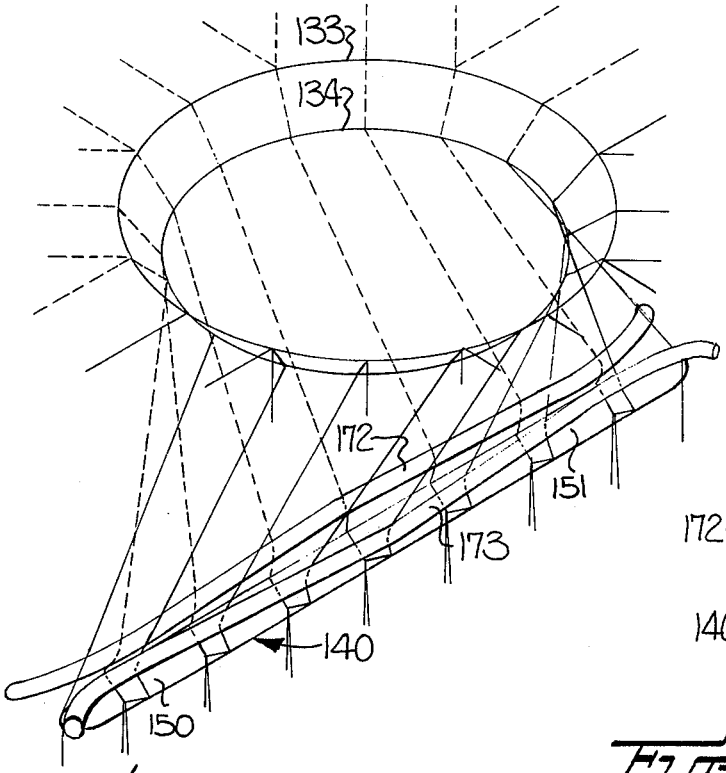
Figure 14:
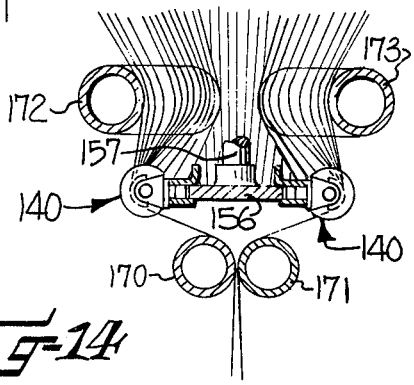
Figure 13:
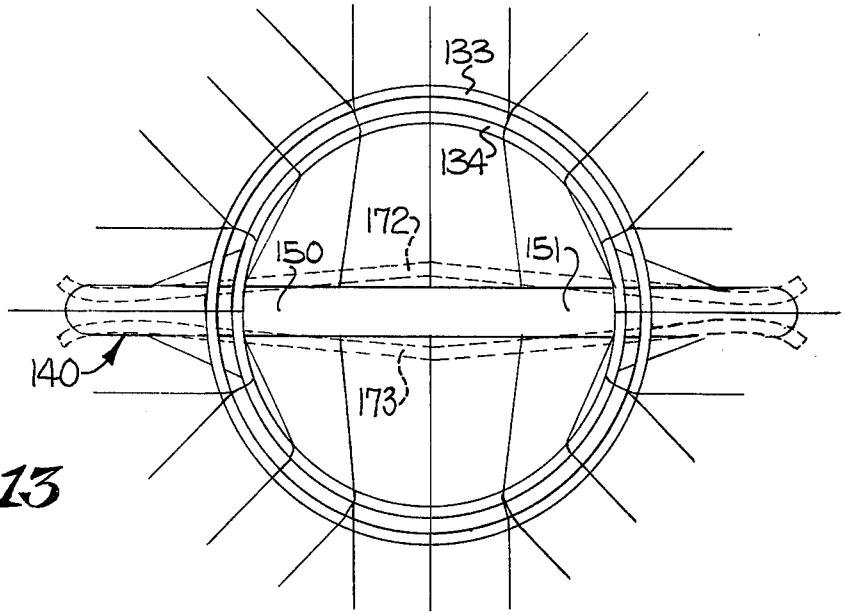

FIGS. 5 through 9 are a series of elevation views, partially in section, taken generally along the respective lines 5—5 through 9—9 in FIG. 4;

FIG. 10 is an enlarged elevation view, partially in section, of a portion of the apparatus illustrated in FIG. 9;

FIG. 11 is an enlarged perspective view of yarn carriers as illustrated in FIG. 10;

FIG. 12 is a view similar to FIG. 3 showing a modified form of the warp strand guide arrangement of this invention;

FIG. 13 is a view similar to FIG. 4, showing the arrangement of FIG. 12; and FIG. 14 is a view similar to FIG. 10, showing the arrangement of FIG. 12.

While the present invention will be described more fully hereinafter with reference to the accompanying drawings, it is to be understood at the outset that it is contemplated that persons skilled in the art of weaving machines may be able to make other and further adaptations of the principles to be hereinafter described. Accordingly, the description which here follows is to be understood as a broad and enabling disclosure of this invention, rather than being limiting and restrictive on the scope of this invention.

Figure 2:
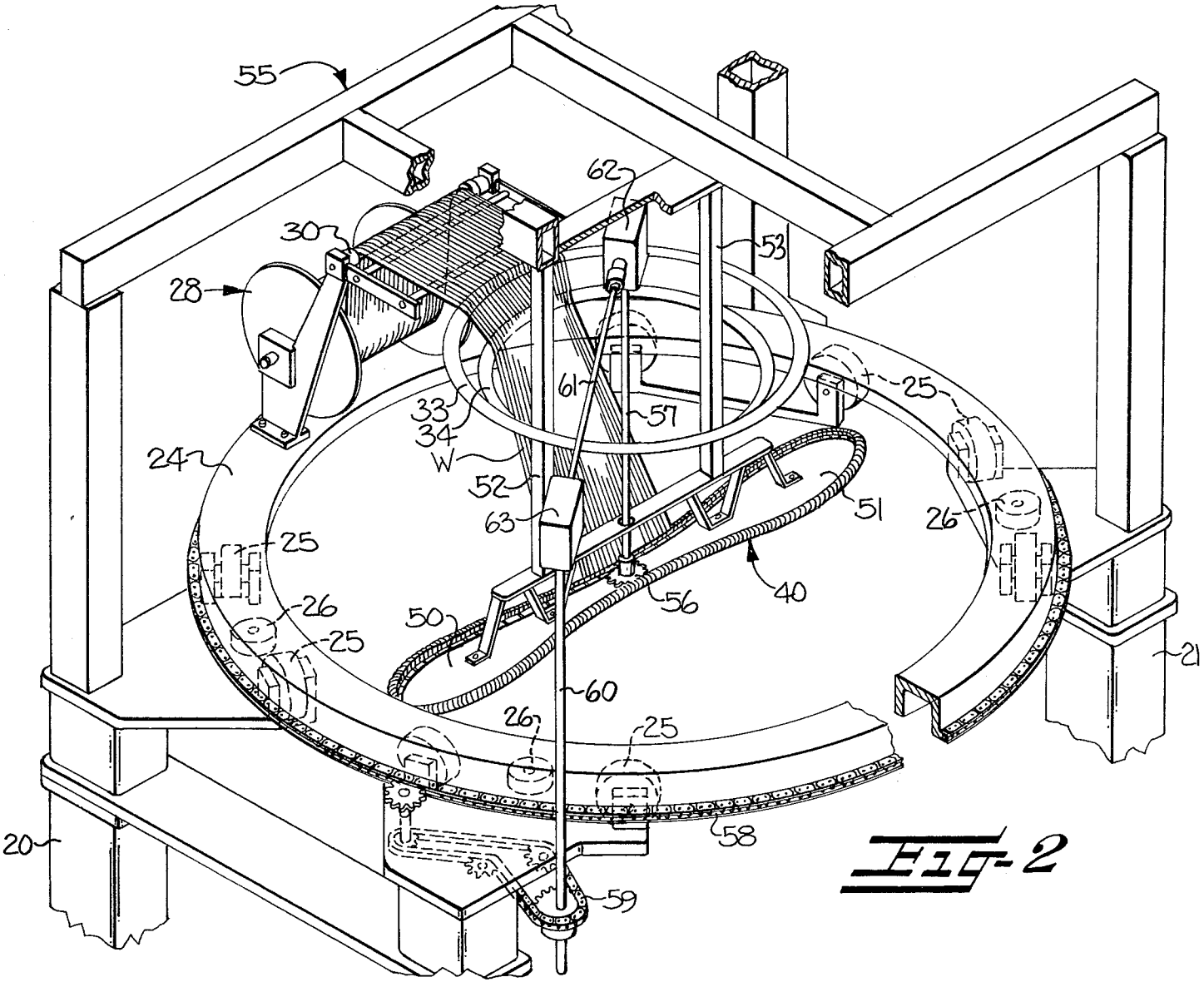
FIG. 2 is a perspective view of portions of the weaving machine of FIG. 1, partly in section and partly broken away, illustrating elements of the warp strand guide arrangement in accordance with this invention.

A weaving machine for making triaxial fabrics constructed in accordance with the present invention preferably has a generally upright orientation, with a plurality of main frame members. Two of the main frame members 20, 21 are indicated in FIG. 2.

Creel means for the weaving machine include a ring member 24 supported from the main frame members of the weaving machine for rotation about a vertically disposed axis. In the form illustrated, the ring member 24 has a generally channel shaped cross-section (FIG. 2) and is supported by a plurality of horizontal rollers 25 mounted from the main frame members 20, 21 of the weaving machine. The ring member 24 is guided in its rotational movement by a plurality of vertical rollers 26.

Figure 1:
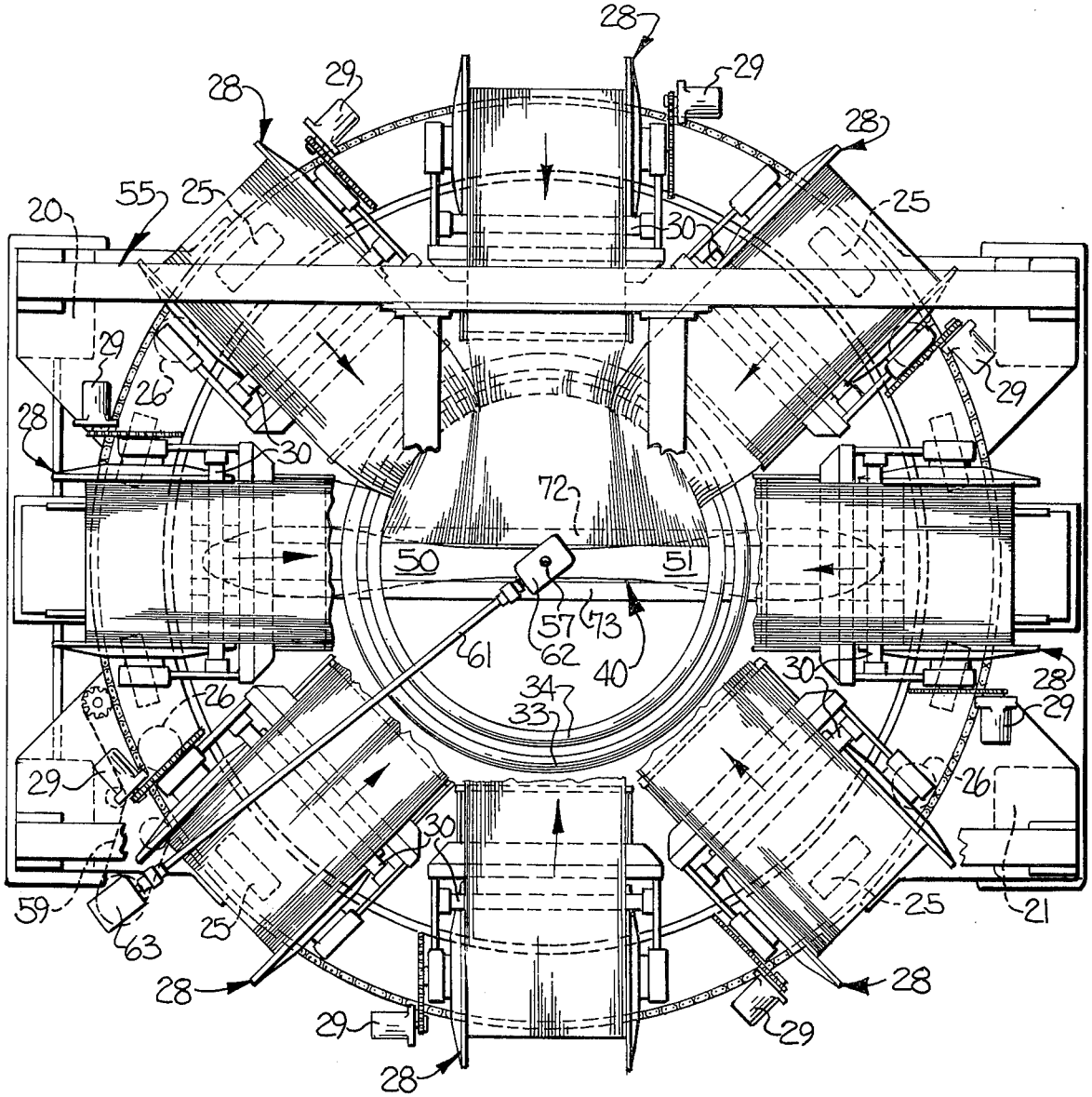
FIG. 1 is a plan view of a weaving machine for making traixial fabrics and incorporating an improved warp strand guide arrangement in accordance with this invention.

In order to supply warp strands for the weaving of triaxial fabrics by the weaving machine in accordance with the present invention, a plurality of warp strand beams are mounted on the ring member 24. Each beam is mounted for rotation about a corresponding axis and supplies a corresponding group of warp strands. One beam is generally indicated at 28 in FIG. 2 and each of the plurality of beams shown in FIG. 1 is similarly designated. The construction of a warp beam 28 and associated mechanism may be determined by persons skilled in the art of weaving textile fabrics and, accordingly, will not be here described in great detail. It is noted that each warp beam may be driven by a corresponding let-off motor indicated at 29 and that warp strands indicated at W delivered from the warp beams 28 may pass over corresponding whip rolls indicated at 30.

In the triaxial weaving machine of this invention, warp strands supplied by the creel are directed to weaving instrumentalities arranged beneath the creel for manipulation with weft yarns in forming triaxial fabrics. Such weaving instrumentalities are indicated generally at 31 and in block diagram form in FIG. 5 and may take forms which vary in specific detail. By way of example, certain weaving instrumentalities for forming triaxial fabrics are shown in Dow et al U.S. Pat. No. 3,799,209 mentioned hereinabove. Other instrumentalities are shown, by way of example, in co-pending U.S. patent application Ser. Nos. 582,246 filed May 30, 1975; 603,657 filed Aug. 11, 1975; and 603,756 filed Aug. 11, 1975 and all owned in common with the present invention. To the extent that the disclosures of such prior patents and co-pending applications are required for a full and complete understanding of the present invention, such disclosures are hereby incorporated by reference into this description.

In operation of the weaving instrumentalities of the triaxial weaving machine of the present invention, the warp strands are guided into an array of two sheets of generally parallel warp yarns. A plurality of elongate heddles 32 (FIGS. 6–9) are arranged in weftwise rows, have warp strand guide openings extending through nose portions thereof for receiving and guiding the warp strands, and cooperate with means which longitudinally move the heddles so as to form the warp strands guided thereby into warp sheds, into which wefts are inserted. The warp strands are shifted weftwise during weaving, with the direction of weftwise movement of warp strands in one of the sheets being opposite to that of warp strands in the other of the sheets. As warp strands reach an edge of each of the sheets, they are transferred to the adjacent edge of the other sheet, to continue weftwise movement. Triaxial fabric woven by such interengagement of warp strands and wefts is suitably taken up in a roll.

As will be appreciated, weftwise displacement of warp strands and rotation of the creel in timed relation with such weftwise shifting would give rise to differences in the length of the warp strand path from the corresponding beam 28 to the weaving instrumentalities were it not for the provision of means for guiding the warp strands along substantially constant length paths irrespective of the weftwise position of the warp strands. Such a potential differential in warp strand paths will be understood to arise from the circular array of the beams 28 (FIG. 1) and the warp strand array of two sheets of generally parallel strands at the weaving instrumentality location (FIGS. 3 and 5 through 9).

In accordance with the present invention, warp strands passing from the creel to the heddles of the weaving instrumentalities are guided along substantially constant length paths by the cooperation of a generally circular first guide means, yarn spearator means mounted for movement about a closed path of travel substantially parallel to the weftwise rows of heddles, and second guide means which maintain the warp strands in engagement with the yarn separator means.

Referring now more particularly to the various elements of the improved means for guiding warp strands in accordance with this invention, the first guide means preferably takes the form of a generally circular member having a diameter less than the weftwise length of the rows of heddles and the triaxial fabric being made (FIGS. 2 and 5) and less than the shortest distance between warp strands wound on opposing ones of the beams 28. In the specific form illustrated, the first guide means comprises first and second ring members 33, 34 spaced one from another and together defining a downwardly converging, generally conical zone having a central axis concentric with the vertical axis of rotation of the creel means. The ring members 33, 34 preferably are supported from the creel support ring 24, for rotation therewith, in order to minimize sliding friction of warp strands W with the ring members 33, 34. As will be recognized, the ring members direct all of the warp strands through a common circular guide zone.

From the first guide means, the warp strands pass to yarn separator means mounted in spaced relation to the first guide means and substantially parallel to the rows of heddles for movement in timed relation with weftwise shifting of the warp strands and rotation of the creel. In the form illustrated, the yarn separator means takes the form of a plurality of block means each for engaging a corresponding plurality of warp strands. Several of such block means are shown and individually generally designated at 40 in FIG. 11. The group of block means 40 are connected together to form an endless flexible loop which extends along a closed path of travel as described hereinafter, preferably in a chain which additionally functions as a portion of a drive means for the loop. Each block means 40 has a plurality of divider plates 41 between which warp strands are received and a vertically projecting tab portion 42.

Figure 5:
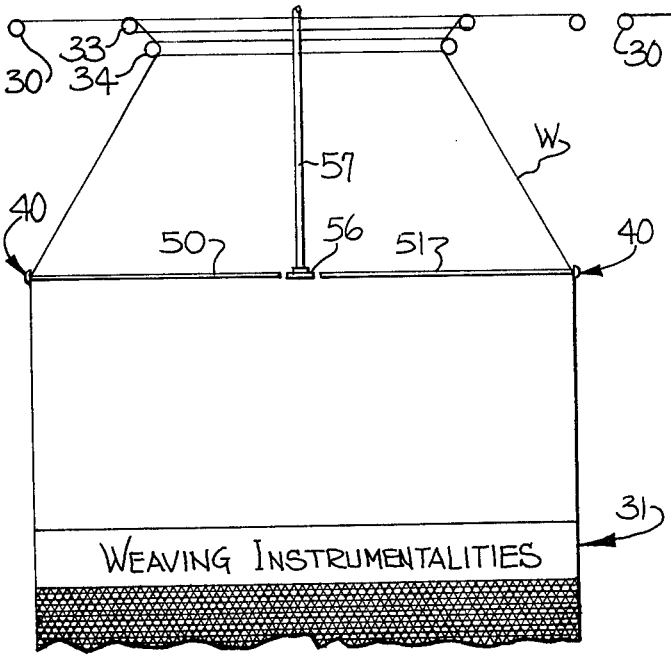
Figure 6:
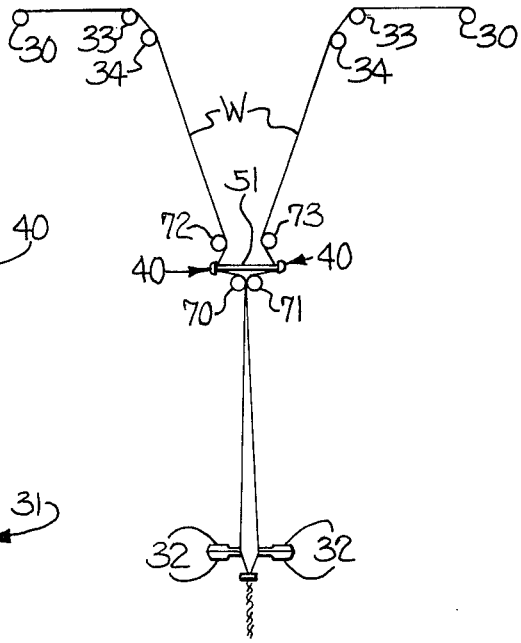
Figure 7:
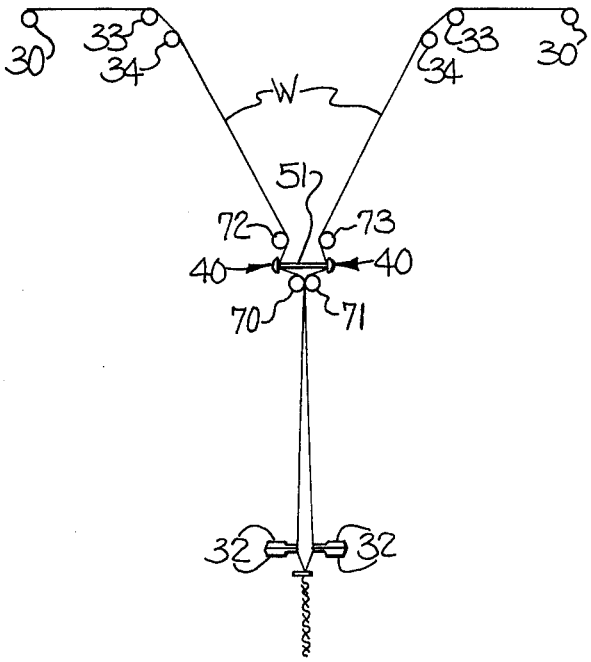
Figure 8:
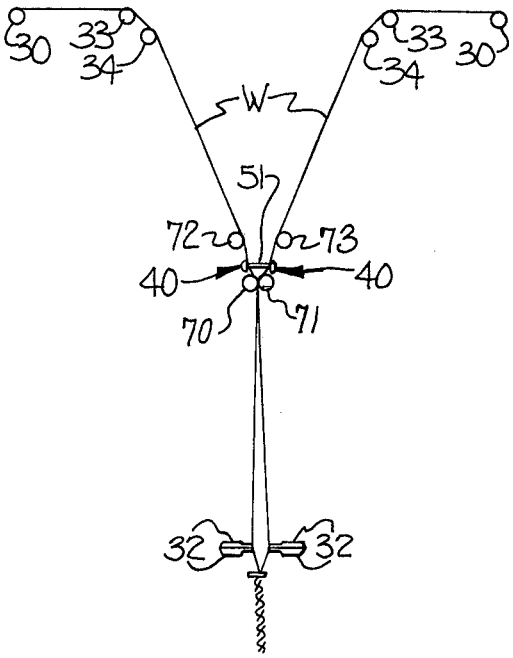

As illustrated in FIGS. 1 through 4 and 6 through 9, the block means 40 move about a block guide means which defines for the endless flexible loop a closed path of travel substantially parallel to the rows of heddles. The block guide means has an elongate, generally planar form; a lenght substantially equal to the weftwise length of the rows of heddles; and bulbous end portions (FIGS. 2 and 5 through 11). In the form illustrated, the block guide means is defined by a pair of "propeller blade" shaped members 50, 51 which together have a generally lemniscate form. The two members 50, 51 are stationarily mounted substantially in weftwise alignment with the rows of heddles and parallel thereto from depending legs 52, 53 which pass downwardly through the guide rings 33, 34 from an overlying superstructure frame generally indicated at 55. The superstructure frame 55 is in turn supported from the main frame members 20, 21 of the weaving machine. It will be noted that the block guide means defined by the members 50, 51 has a double symmetry (FIG. 4). More particularly, the block guide means taken as an entity is symmetrical about the perpendicular center lines through the plane thereof, namely, the lines along which FIGS. 5 and 9 are taken.

The loop formed by the series of yarn separator means 40 is driven in movement about the block guide means by a drive sprocket 56 (FIGS. 2, 5, 9 and 10) fixed to the lower portion of a drive shaft 57. The drive shaft 57 is driven in timed relation to rotation of the creel mounting ring 24 by an appropriate transmission means (FIG. 2) including a drive chain 58 secured about the periphery of the support ring 24, sprocket and chain means generally indicated at 59 for transmitting rotation to a first jack shaft 60, a horizontal jack shaft 61, and appropriate cooperating transmission means 62, 63 for transmitting rotation from the sprocket and chain means 59 to the central drive shaft 57.

In order to maintain alignment of the yarn separator means 40 during passage thereof between the blade members 50, 51 of the block guide means, an overlying restraining member 65 is provided in a central portion of the block guide means (FIG. 10). As an individual block means 40 moves into the central portion of the block guide means, the upstanding tab portion 42 thereof is engaged by the restraining member 65, to maintain alignment of the yarn separator means 40 during engagement thereof with the drive sprocket 56. At other portions of the closed path of movement about the block guide means, the position of the block means 40 is maintained by engagement of links thereof with upper and lower surfaces of the planar elements 50, 51 of the lower guide means.

In order to maintain warp strands in engagement with the yarn separator block means 40 and with the strands distributed between the divider plates 41 thereof, the present invention further provides second guide means shown as taking the form of a plurality of strand engaging straight rod means adjacent to and straddling the block guide means. More particularly, a pair of first rod means 70, 71 engage the warp strands intermediate the block guide means and the weaving instrumentalities and closely adjacent one another and the block guide means, while a pair of second rod means 72, 73 similarly engage warp strands between one guide ring 34 and the block guide means. By such an arrangement, as made more clear in FIGS. 6 through 9, portions of the warp strands are confined on opposite sides of an elongate zone of engagement with the yarn separator block guide means and maintained in engagement with the yarn separator block means so that the irregular contour of the block guide means including the bulbous end portions thereof contributes to guiding the warp strands along substantially constant length paths in accordance with the objects of this invention by deflecting the warp strands of various weftwise positions into various angular relations with the closed path of travel about which the block means move and with the straight rod means.

It is to be noted that the first rod means 70, 71 serve a further function in defining a weftwise zone from which the two sheets of warp strands diverge toward the heddles. Where deemed appropriate or necessary, the first and second rod means may be made in a freely rotatable roller configuration or have repetitive small oscillatory motions applied thereto as a "dither" to reduce friction between the rod means and warp strands engaging the rods.

It is contemplated that deflection of warp strands in a manner such as to accomplish guidance of warp strands along substantially constant length paths may also be done with yarn separator means supported to move along a closed path of travel having parallel weftwise runs, and such a modified form of this invention is shown in FIGS. 12 and 13. In those Figures, only a schematic illustration is given, and components corresponding to those described hereinabove have been identified by similar reference character of a 100 magnitude series. For purposes of reducing the length of this description, attention will be directed only to points of distinction.

In particular, the second rod means 172, 173 as used in the modified form of this invention have a bowed configuration, in order to compensate for the distinction between the lemniscate form of the block guide means 50 of FIGS. 1 through 11 and the parallel weftwise runs of the block guide means 150 of the modified form. Other details of the arrangements may be as described above.

In both forms of the present invention, as applied to the vertical arrangement chosen for illustration, it will be recognized that the ring members 33, 34, 133, 134 are positioned above the rod means 70, 71, 72, 73, 170, 171, 172, 173 and thus function as upper guide means. Complementarily, the rod means may be described as lower guide means.

In the drawings and speecification, there has been set forth a preferred embodiment of the invention, and although specific terms are employed, they are used in a generic and descriptive sense only and not for purposes of limitation.

That which is claimed is:

1. In a weaving machine for making triaxial fabrics and having a plurality of elongate heddles arranged in weftwise rows for guiding warp strands, means for shifting the warp strands weftwise during weaving, creel means for supplying warp strands for weaving and mounted for rotation in timed relation with weftwise shifting of the warp strands, and means for guiding warp strands passing from said creel means to said heddles along substantially constant length paths, the improvement wherein said warp strand guiding means comprises generally circular first guide means for engaging all the warp strands and having a diameter less than the weftwise length of said rows of heddles, yarn separator means for engaging warp strands intermediate said first guide means and said heddles and being mounted for movement in timed relation with weftwise shifting of the warp strands and rotation of said creel means, and second guide means adjacent to and cooperating with said yarn separator means for maintaining engagement of said warp strands with said yarn separator means.

2. A weaving machine according to claim 1 wherein said creel means is mounted for rotation about a vertical axis, said heddles are arranged beneath said creel means, and warp strands extend downwardly from said first guide means to said second guide means and said yarn separator means.

3. A weaving machine according to claim 1 wherein said first guide means comprises a ring member having a diameter of approximately one-half the weftwise length of said rows of heddles.

4. A weaving machine according to claim 1 wherein said first guide means comprises a pair of ring members mounted generally concentrically with the rotational axis of said creel means and at spaced locations therealong, said ring members together defining a conical warp strand zone converging toward said second guide means.

5. A weaving machine according to claim 1 wherein said yarn separator means comprises a plurality of block means, each for engaging a corresponding plurality of warp strands; block guide means for engaging said block means and defining a closed path of travel substantially parallel to said rows of heddles; and drive means for moving said block means about said closed path of travel in timed relation with weftwise shifting of the warp strands.

6. A weaving machine according to claim 5 wherein said second guide means comprises straight rod means mounted adjacent said closed path of travel and further wherein said closed path of travel defined by said block guide means has a generally lemniscate form for deflecting warp strands at various weftwise positions into various angular relations to said straight rod means.

7. A weaving machine according to claim 5 wherein said closed path defined by said block guide means has parallel weftwise runs and further wherein said second guide means comprises bowed rod means mounted adjacent said parallel runs for engaging warp yarns and for deflecting warp strands at various weftwise positions into various angular relations to said closed path.

8. A weaving machine according to claim 5 wherein said drive means comprises means connecting said block means together in an endless, flexible loop extending along said closed path of travel.

9. In a weaving machine for making triaxial fabrics and having a plurality of elongate heddles arranged in weftwise rows for guiding warp strands, means for shifting the warp strands weftwise during weaving, creel means for supplying warp strands for weaving and mounted above said rows of heddles for rotation about a vertical axis in timed relation with weftwise shifting of the warp strands, and means for guiding warp strands passing from said creel means to said heddles along substantially constant length paths, the improvement wherein said warp strand guiding means comprises generally circular upper guide means having a diameter less than the weftwise length of said rows of heddles, yarn separator means arranged in an endless flexible loop and mounted for movement about a closed path of travel substantially parallel to said rows of heddles and in timed relation with weftwise shifting of the warp strands and rotation of said creel means, and lower guide means adjacent to and cooperating with said yarn separator means for maintaining engagement of said warp strands with said yarn separator means.

10. A weaving machine according to claim 9 wherein said heddles and said means for guiding warp strands cooperate for positioning said warp strands generally in two sheets and further wherein said lower guide means comprises first rod means positioned intermediate said yarn separator means and said heddles for defining a weftwise zone from which said two sheets of warp strands diverge toward said heddles and second rod means positioned intermediate said upper guide means and said yarn separator means for cooperating therewith in deflecting warp strands at various weftwise positions into various angular relations to said closed path.

11. A weaving machine according to claim 10 wherein said first rod means comprises a pair of straight rod members mounted parallel one to another and to said weftwise rows of heddles, said pair of rod members being spaced closely adjacent one another and having a weftwise length substantially equal to the weftwise length of said rows of heddles.

12. A weaving machine according to claim 10 wherein said second rod means comprises a pair of straight rod members mounted parallel one to another and to said weftwise rows of heddles, said pair of rod members having a weftwise length substantially equal to the weftwise length of said rows of heddles.

13. In a method of making triaxial fabrics in which a plurality of warp strands supplied from a rotating creel are guided along constant length paths to be received in warp strand guide openings extending through nose portions of elongate heddles arranged in weftwise rows and moved weftwise by shifting of the heddles, the improvement in the guiding of warp strands to facilitate their movement during weaving which comprises directing all the warp strands through a common circular guide zone having a diameter less than the weftwise dimension of the rows of heddles, while positioning portions of the warp strands intermediate the zone and the heddles in a weftwise array substantially aligned with the rows of heddles, and while moving the warp strand portions weftwise in timed relation with rotation of the creel and in timed relation with shifting of the heddles.

14. A method according to claim 13 wherein the moving of the warp strand portions weftwise comprises moving the same about a closed path of travel having a generally lemniscate form.

15. A method according to claim 13 wherein the positioning of the warp strand portions in a weftwise array comprises confining the warp strand portions on opposite sides of an elongate zone.

16. A method according to claim 13 wherein the positioning of the warp strand portions in a weftwise array comprises passing the same through a weftwise elongate zone parallel to the weftwise row of heddles while guiding the warp strand portion into two sheets of generally parallel strands.

17. In a method of making triaxial fabrics in which a plurality of warp strands supplied from a rotating creel are guided along constant length paths to be received in warp strand guide openings extending through nose portions of elongate heddles arranged in weftwise rows and moved weftwise by shifting of the heddles, the improvement in the guiding of warp strands to facilitate their movement during weaving which comprises directing all the warp strands through a common circular guide zone to an elongate zone parallel to the rows of heddles while confining portions of the warp strands on opposite sides of the elongate zone to position such portions of the warp strands in weftwise array of two sheets of generally parallel warp strands substantially aligned with the rows of heddles, and while moving such warp strand portions weftwise in timed relation with rotation of the creel and in timed relation with shifting of the heddles.

* * * * *

UNITED STATES PATENT AND TRADEMARK OFFICE

CERTIFICATE OF CORRECTION

PATENT NO. : 4,036,262

DATED : July 19, 1977

INVENTOR(S) : Burns Darsie and Richard A. Schewe

It is certified that error appears in the above-identified patent and that said Letters Patent are hereby corrected as shown below:

In the References Cited: "Trautuetter" should be --Trautvetter--.
Column 1, line 8, before "28,155" insert --Re--.
Column 1, line 18, change "axial" to --triaxial--.
Column 1, line 38, omit "and rotation of a creel".
Column 1, line 39, omit "from which the warp strands".
Column 1, line 42, after "invention" insert --will--.
Column 1, line 46, change "traixial" to --triaxial--.
Column 1, line 54, after "strand" insert --guide--.
Column 3, line 30, change "spearator" to --separator--.
Column 4, line 8, change "lenght" to --length--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*